United States Patent [19]

Romak

[11] Patent Number: 4,550,972

[45] Date of Patent: Nov. 5, 1985

[54] CYLINDRICAL SOCKET CONTACT

[75] Inventor: Paul E. Romak, Langen, Fed. Rep. of Germany

[73] Assignee: AMP Incorporated, Harrisburg, Pa.

[21] Appl. No.: 598,127

[22] Filed: Apr. 9, 1984

[51] Int. Cl.[4] ..... H01R 13/11

[52] U.S. Cl. ..... 339/256 R; 339/259 R; 339/262 R

[58] Field of Search ..... 339/256 R, 258 R, 258 P, 339/259 R, 262 R

[56] References Cited

U.S. PATENT DOCUMENTS

| | | | |
|---|---|---|---|
| 3,317,887 | 5/1967 | Henschen et al. | 339/256 R |
| 4,002,400 | 1/1977 | Evans | 339/258 R |
| 4,152,042 | 5/1979 | Ostapovitch | 339/258 R |
| 4,269,472 | 5/1981 | Shaffer et al. | 339/259 R |

*Primary Examiner*—John McQuade

*Attorney, Agent, or Firm*—F. W. Raring

[57] ABSTRACT

Stamped and formed contact socket has a first circumferentially continuous ring at its pin receiving end and a second circumferentially continuous ring at its inner end. An intermediate portion of the socket comprises an even number plurality of pairs of beams which have their ends integral with the first and second rings. Inwardly formed spherical bosses are provided on the rings which engage a pin upon movement of the pin into the socket. The bosses are spaced along the axis of the socket and are encountered sequentially during movement of the pin into the socket.

3 Claims, 7 Drawing Figures

2
4
5
8
10
12
14
16
18
20
22
26
28a
28b
30a
30b
32a
32b
34a
34b
36
38
42
44

CYLINDRICAL SOCKET CONTACT

FIELD OF THE INVENTION

This invention relates to stamped and formed contact sockets of the type which receive electrical contact pins.

BACKGROUND OF THE INVENTION

A commonly used type of contact terminal comprises a stamped and formed conductive metal cylindrical socket which is dimensioned to receive a cylindrical pin. Contact terminals of this type are widely used, often in multicontact electrical connectors and are also used in connectors containing only one or two terminals.

Contact sockets of this type must be dimensioned such that when the pin is inserted into the socket, a contact force will be exerted by the socket on the pin to form a stable electrical connection. Frequently, a separate contact spring is mounted on the socket and when the pin is inserted into the socket, the spring is deflected and forces the surface of the pin against the surface of the contact. In order to obtain a stable electrical connection between an inserted pin and a socket, it is desirable that the contact spring should exert a relatively high force on the contact. However, the higher the contact force exerted by the spring on the pin, the greater the force required to insert the pin into the socket, in other words, the greater the insertion force required to mate the pin with the socket. High insertion forces are not desirable in pin-and-socket type contacts and, as a result, such contact terminals quite often represent a compromise design which has an acceptable insertion force requirement coupled with an acceptable contact force in the coupled contact pair. The present invention is directed to the achievement of an improved contact socket which is capable of exerting a relatively high contact force on an inserted pin and which does not require an unduly high insertion force when it is mated with the contact pin.

THE INVENTION

The invention comprises a cylindrical stamped and formed contact socket which is intended to receive a contact pin. The socket has an open pin receiving end and an inner end, and the inside diameter of the socket is substantially equal to, and greater than, the diameter of the pin. The socket is characterized in that the socket has a first circumferentially continuous ring at the pin receiving end and a second circumferentially continuous ring at the inner end. An intermediate portion of the socket which is between the first and second rings comprises an even number plurality of at least four substantially identical beams which have their ends integral with the first and second rings. The beams are located at equally spaced angular intervals around the axis of the socket so that a plurality of pairs of diametrically opposed beams are provided. Each of the beams has a contact boss thereon which projects inwardly towards the axis of the socket, the bosses on each pair of opposed beams being aligned with respect to the axis of the socket. The minimum distance between the surfaces of the bosses is substantially equal to, and less than, the diameter of the contact pin. The associated pairs of beams have their bosses spaced from the first ring at increasing distances whereby, during insertion of the pin into the socket, the bosses on the associated pairs of beams are sequentially encountered by the pin and the beams are sequentially deflected. After the pin is fully inserted, it is in contact with the socket at a plurality of equally spaced intervals along its axis and around its circumference.

In accordance with further embodiments, the socket has an axially extending seam and a cylindrical supporting sleeve is mounted on the socket in surrounding relationship to the seam. In accordance with further embodiments, the bosses have spherical surfaces and at least three pairs of diametrically opposed beams are provided.

THE DRAWING FIGURES

Figures 2, 4, 5, 7:
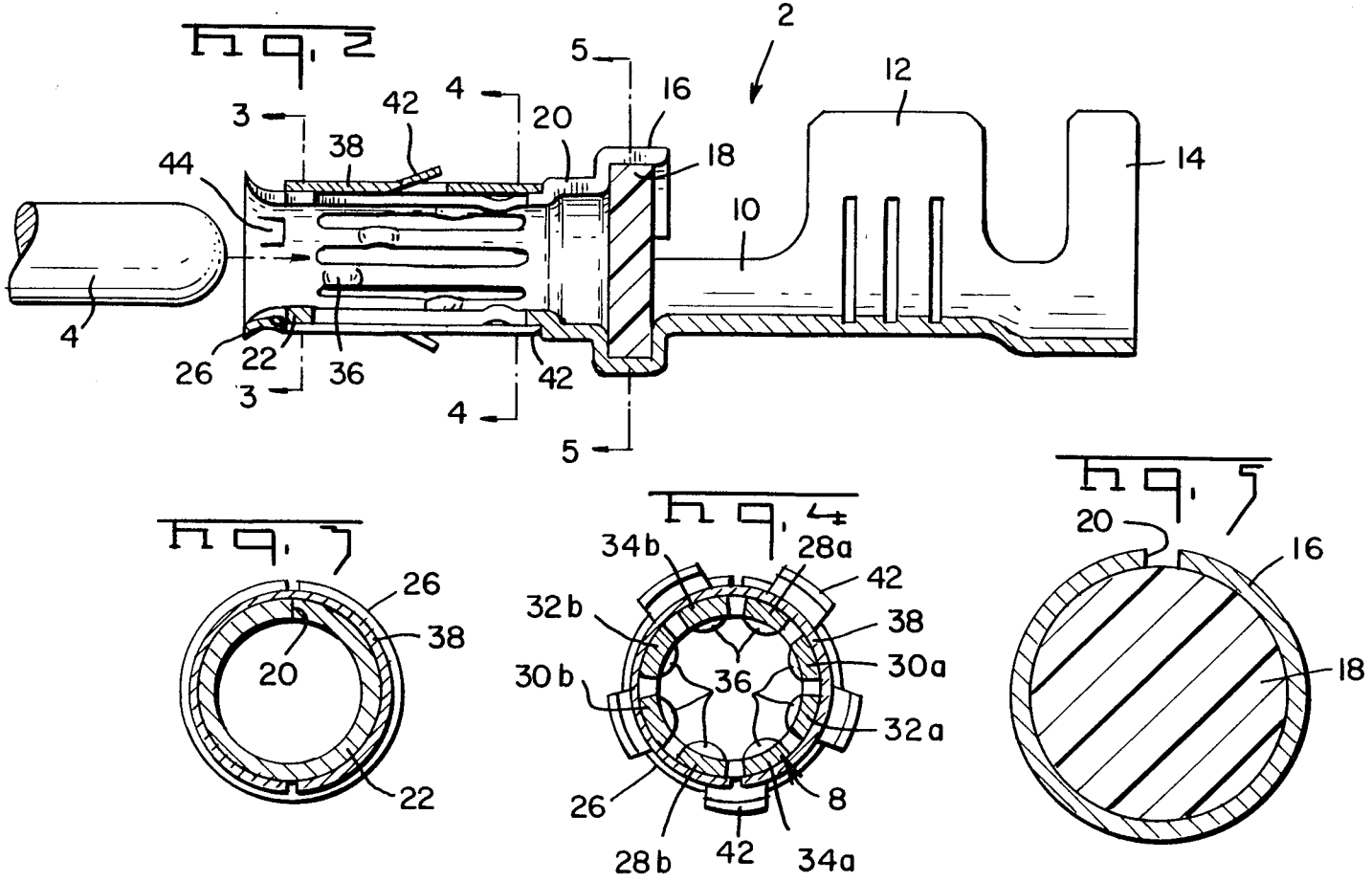
FIG. 2 is a side view showing a contact pin in alignment with the socket.

FIGS. 3, 4 and 5 are views taken along the lines 3—3, 4—4 and 5—5 of FIG. 2.

Figure 1:
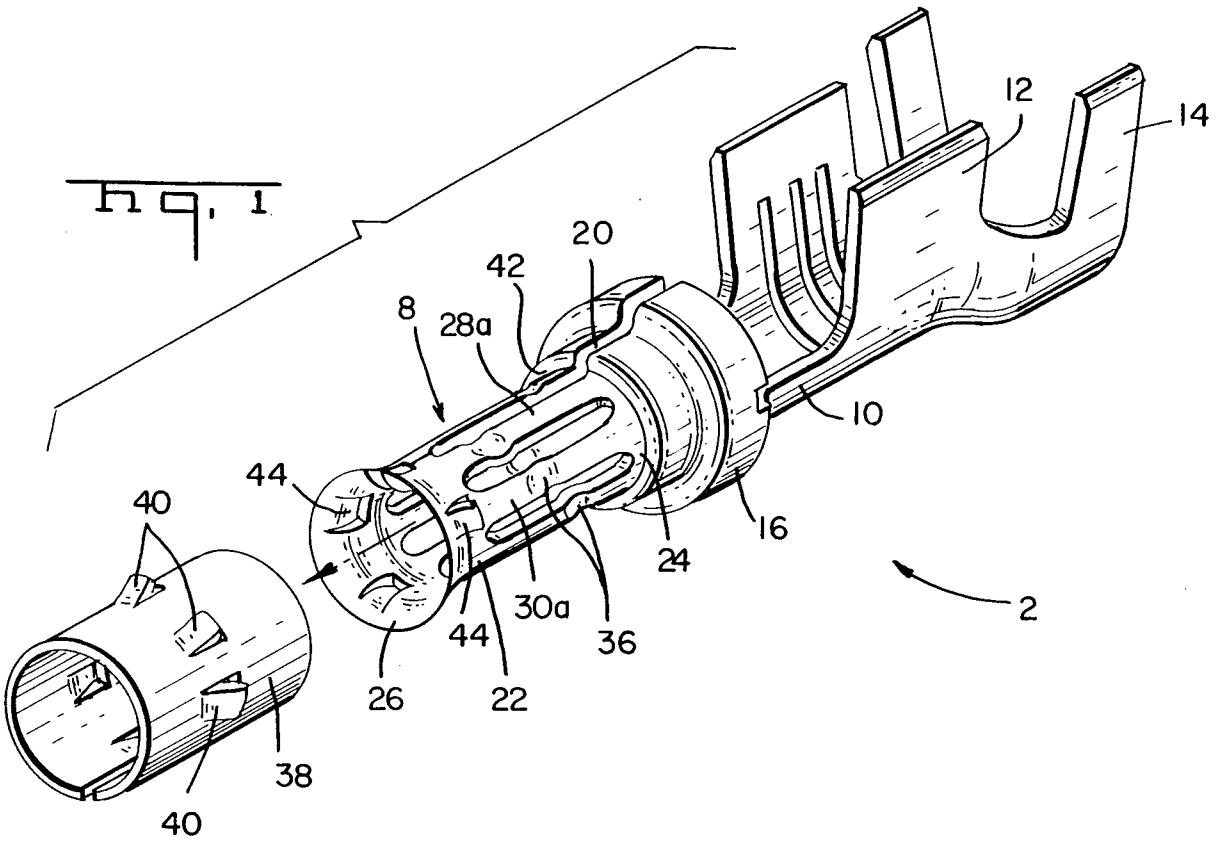
FIG. 1 is a perspective view of a contact socket in accordance with the invention showing the supporting sleeve as exploded from the body of the socket.
Figure 6:
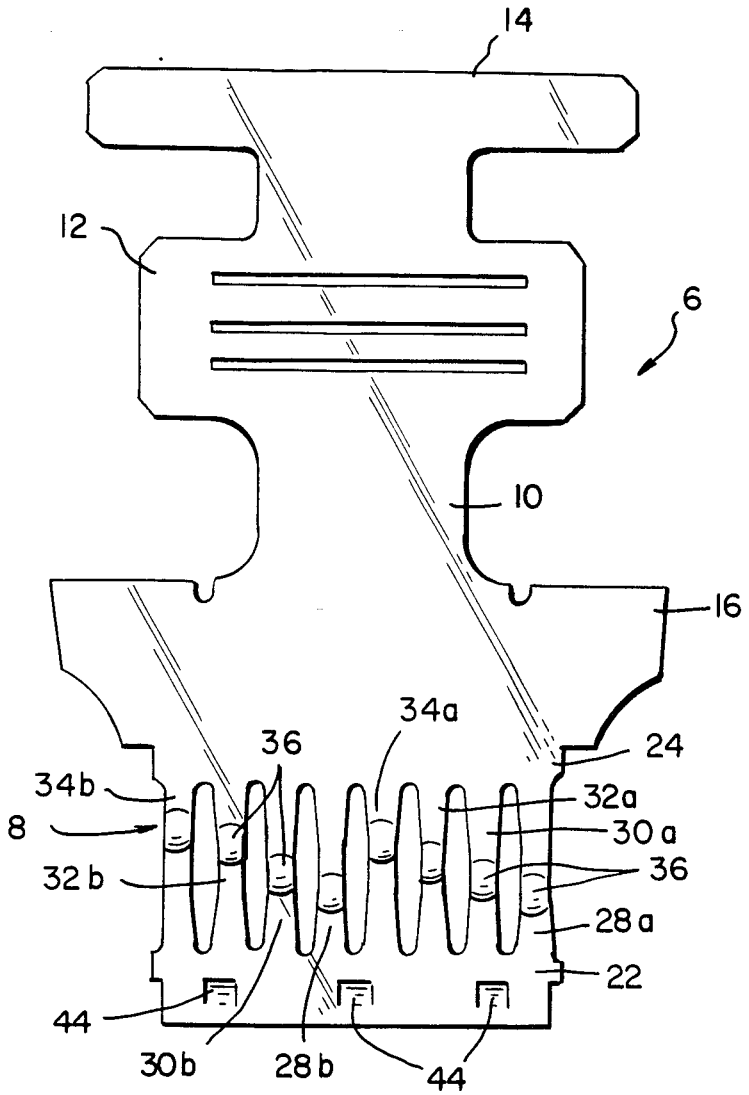
Figure 7:
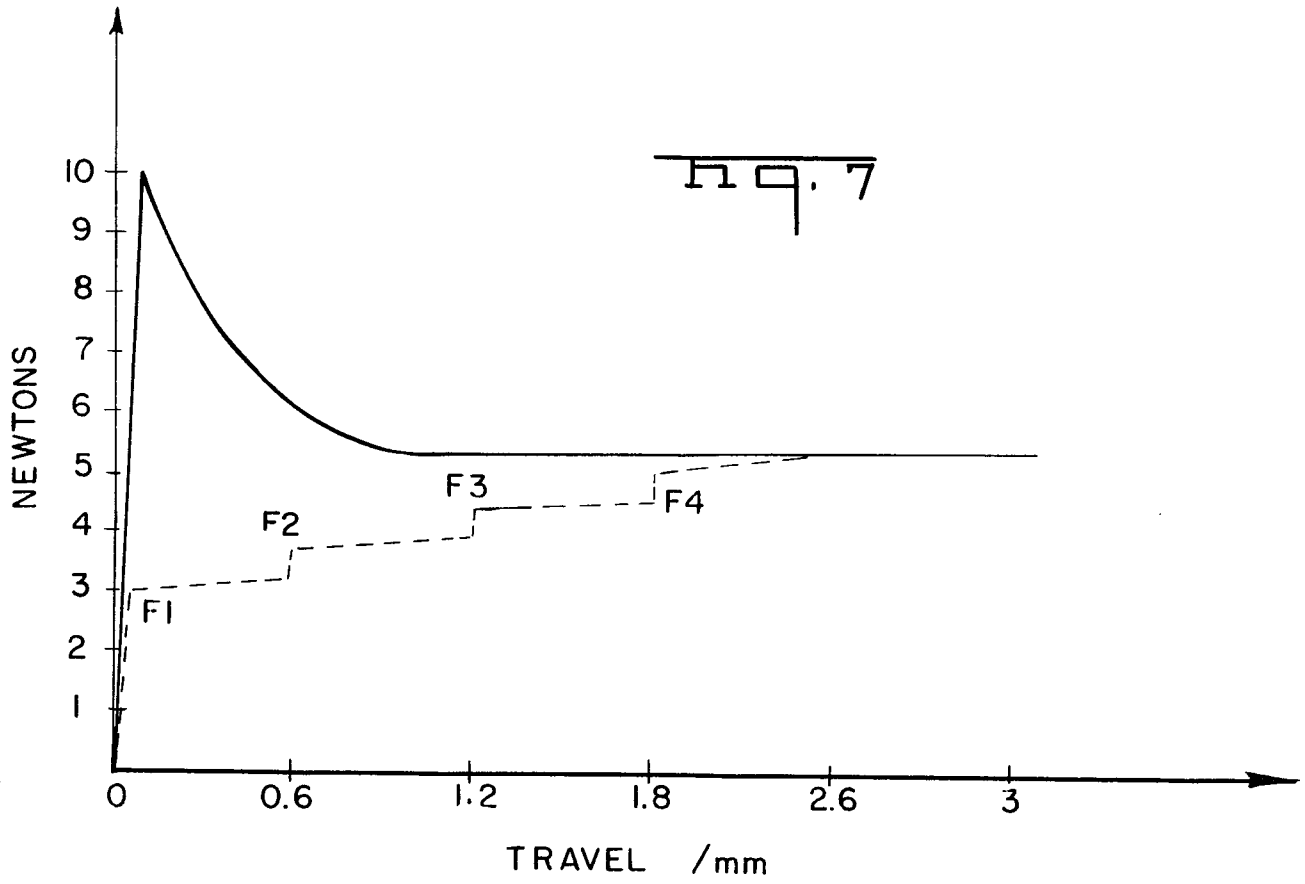

FIG. 6 is a plan view of the flat blank from which the socket of FIG. 1 is formed.

FIG. 7 shows insertion force-travel curves comparing a socket in accordance with the invention with an alternative type of socket, these curves being based on calculated values rather than on actual data.

THE DISCLOSED EMBODIMENT

A contact socket 2 in accordance with the invention is adapted to receive a contact pin 4 thereby to form a disengageable electrical connection between conductors secured to the pin and socket respectively. The socket 2 is formed from a flat blank 6, FIG. 6, and the parts of the blank are identified by the same reference numerals as those used in the following description of the socket.

Socket 2 comprises a cylindrical receptacle portion 8 from which extends a connecting neck 10 to a U-shaped crimping portion 12 and an adjacent U-shaped crimping portion 14. The crimping portion 12 is adapted to be crimped onto the conducting core of a wire and the portion 14 is adapted to be crimped onto the insulation of the wire. The contact socket shown has an enlarged cylindrical section 16 between the portion 8 and the connecting neck 10 and a plug 18 is contained in this enlarged section for sealing purposes. This plug and the enlarged section are not part of the present invention.

The contact socket is formed from the flat blank of FIG. 6 and, after forming of the cylindrical portion, a seam 20 extends axially from the enlarged cylindrical section 16 to the pin receiving end of the socket. It is desirable, for reasons which will be explained below, that the seam not be permitted to open up or to move apart when the pin 4 is inserted into the socket and, to prevent such opening of the seam, the seam can be welded shut. However, in the present invention a supporting sleeve 38 is provided to prevent opening of the seam as will also be described below.

The cylindrical receptacle portion 8 comprises a first circumferentially continuous ring 22 which is adjacent to the pin receiving end of the socket and a second circumferentially continuous ring 24 which is at the inner end of the cylindrical portion 8. The pin receiving end may be flared outwardly as shown at 26 to guide the pin into the socket.

The intermediate portion of the cylindrical portion 8 between the rings 22, 24 is composed of a plurality of associated pairs of beams which extend axially and which have their ends fixed to the rings 22, 24. In the embodiment shown, four pairs of opposed beams 28*a*, 28*b*, 30*a*, 32*a*, 32*b*, and 34*a*, 34*b*. The two beams of each pair are diametrically opposed to each other with respect to the axis of the receptacle portion 8 and the beams are substantially identical to each other so that they will behave in a uniform manner when deflected.

Each beam is provided with an inwardly-projecting spherical contact boss 36 with the bosses of each associated pair being aligned with each other as shown best by FIG. 6. In other words, the bosses 36 of the beams 28*a*, 28*b* are located at the same distance from the pin receiving end while the bosses on the beams 30*a*, 30*b* are both located at a slightly greater distance from the pin receiving end. The shortest distance between the bosses of each pair of beams is substantially equal to, and slightly less than, the diameter of the pin 4. The inside diameter of the receptacle portion is otherwise substantially equal to, and slightly greater than, the diameter of the pin. As a result, when the pin is inserted into the receptacle portion 8, the individual beams are deflected and each boss therefore imposes a contact force on the surface of the pin.

In the disclosed embodiment, a supporting sleeve 38 is mounted on the receptacle portion and bears against a shoulder 42 at the inner end of the receptacle portion. At its forward end, this sleeve is held in position by lances 44 that are struck from the first continuous ring 22. The sleeve itself may have lances 40 for the purpose of retaining the terminal in a connector housing.

FIG. 7 shows, in the broken line curve, the force travel curve which is obtained when a socket in accordance with the invention is mated with a contact pin. This broken line curve and the solid curve which is explained below are both based on mathematic analyses rather than actual data. It is apparent from FIG. 7 that, when a contact pin is inserted into a contact socket in accordance with the invention, there is initially an abrupt increase of the force required to 3N (Newtons) which is caused when the leading end of the pin encounters the first set of opposed bosses on the opposed beams 28*a*, 28*b*. The insertion force increases at a low rate until the second pair of opposed bosses is encountered, at which time the insertion force required rises abruptly to a slightly higher level and this rise is followed by a further gradual increase of the force. Similarly, there is an abrupt rise when the contact bosses on the final two pairs of opposed beams are encountered and the force stabilizes at about 5.5N.

The solid line curve of FIG. 7 shows the conditions which would be encountered if all of the bosses were circumferentially aligned around the axis of the socket at a location adjacent to the pin receiving end. It can be seen that there would be an abrupt rise of the insertion force to 10N, and this initial insertion force requirement would then drop off as shown to a level comparable to the final insertion force required in the practice of the invention. The requirement for an extremely high initial force is highly undesirable, even though this force is required for only a short portion of the travel of the pin. It can readily be appreciated that, when the pin is being manually inserted into the receptacle, the technician might have difficulty in inserting the pin if the force-travel curve is as shown in the solid line, while he might be able to accomplish the insertion relatively easily if it is in accordance with the broken line. The extremely high initial insertion force required for aligned contact bosses (the solid line curve) is caused by the fact that the coefficient of static friction is much greater than the coefficient of sliding friction for the materials involved. When the pin first encounters the bosses in the socket, the person pushing the pin into the socket must overcome the friction which results from the coefficient of static friction, and this value in the calculations presented in FIG. 7 is quite high. After this static friction effect is overcome, the frictional force drops off rapidly and the final stages of the insertion operation require only a relatively low insertion force.

In the practice of the invention (broken line curve), the bosses are encountered by the pin sequentially and, while the coefficient of static friction is the same in both cases, the force is applied gradually when the socket is in accordance with the present invention. In other words, when the pin is inserted into the socket at the pin receiving end, it encounters only two contact bosses so the force exerted on the pin is only one-fourth of the force which is exerted when the conditions of the solid line curve exist. As the pin is inserted, the force is gradually increased but, by the time the pin encounters the second set of bosses, it will be moving over the first set of bosses with only sliding friction forces impeding its further motion.

It should be mentioned that, since the broken line curve is based on mathematical considerations and theoretical considerations rather than actual data, it does not show the drop-off which occurs as a result of the transition from static to sliding friction and the actual curve would look somewhat different from the broken line curve of FIG. 7. However, the general shape of the curve, and particularly the final force requirements for insertion, are valid.

Contact sockets in accordance with the invention possess advantages in addition to the low insertion force requirement discussed in detail above. Since the inserted pin is contacted by eight bosses which are at spaced intervals around the axis of the pin, a contact in accordance with the invention will perform extremely well under conditions of high inertial disturbances as, for example, in rapidly accelerating space vehicles or the like. The high level of redundancy is in itself a highly desirable feature.

I claim:

1. A cylindrical stamped and formed contact socket which is intended to receive a contact pin, the socket having an open pin-receiving end and an inner end, the inside diameter of the socket being substantially equal to, and greater than, the diameter of the pin, the socket being characterized in that:

the socket has a first circumferentially continuous ring at the pin-receiving end, a second circumferentially continuous ring at the inner end, and an axially extending seam which extends from the pin-receiving end to the inner end, an intermediate portion of the socket which is between the first and second rings comprises an even number plurality of at least four substantially identical beams which have ends that are integral with the first and second rings, the beams being at equally spaced angular intervals around the axis of the socket so that a plurality of pairs of diametrically opposed beams are provided, each of the beams having a contact boss which projects inwardly towards the axis of the socket, the bosses on each pair of opposed beams being aligned with respect to the axis of the socket, the minimum distance between the surfaces of the bosses being substantially equal to, and less than, the diameter of the contact pin, the associated pairs of beams having their bosses spaced from the first ring at increasing distances, the pin-receiving end being outwardly flared and a cylindrical supporting sleeve is mounted on the socket in surrounding relationship thereto, the supporting sleeve being between the pin-receiving end and the inner end whereby, during insertion of the pin into the socket, the bosses on the associated pairs of beams are sequentially encountered by the pin and the beams are sequentially deflected, and after the pin is fully inserted it will be in contact with the socket at a plurality of equally spaced intervals along its axis and around its circumference.

2. A cylindrical stamped and formed contact socket as set forth in claim 1 characterized in that the first circumferentially continuous ring has lances struck therefrom, the lances being against the forward end of the sleeve, the inner end of the socket having a shoulder, the sleeve being against the shoulder.

3. A cylindrical stamped and formed contact socket as set forth in claim 2, the sleeve having lances for retaining the terminal in a connector housing.

* * * * *